US005280895A

United States Patent [19]

Meier

[11] Patent Number: 5,280,895

[45] Date of Patent: Jan. 25, 1994

[54] METHOD AND APPARATUS FOR PRODUCING GROUPS FROM DIFFERENT PRINTED PRODUCTS

[75] Inventor: Jacques Meier, Báretswil, Switzerland

[73] Assignee: Ferag AG, Hinwil, Switzerland

[21] Appl. No.: 870,837

[22] Filed: Apr. 20, 1992

[30] Foreign Application Priority Data

Apr. 24, 1991 [CH] Switzerland ..... 1222/91

[51] Int. Cl.[5] ..... B65H 39/02

[52] U.S. Cl. ..... 270/58; 270/54

[58] Field of Search ..... 270/58, 54

[56] References Cited

U.S. PATENT DOCUMENTS

| | | | |
|---|---|---|---|
| 3,825,246 | 7/1974 | Elia et al. | 270/58 |
| 3,953,017 | 4/1976 | Wise | 270/54 |
| 3,966,186 | 6/1976 | Helm . | |
| 4,442,769 | 4/1984 | Kallin | 271/246 X |
| 4,625,954 | 12/1986 | Pusey | 270/58 X |
| 4,799,661 | 1/1989 | Nail | 270/54 |
| 4,887,809 | 12/1989 | Eberle | 271/203 |

*Primary Examiner*—Edward K. Look
*Assistant Examiner*—John Ryznic
*Attorney, Agent, or Firm*—Walter C. Farley

[57] ABSTRACT

The inventive method and apparatus serve to combine into groups different printed products supplied as continuous flows (1, 2, 3 etc.), on at least one grouping section (10.1, 10.2, 10.3), in which each group can have a composition of in each case one product from different supply flows corresponding to a predetermined group sequence. The production of faulty groups is prevented, in that in the supplies errors are detected at an early stage, so that groups affected by an error, are not formed in the predetermined cycle and are instead displaced by one cycle. The group flow leaving the method consequently contains only gaps and not faulty groups. For performing the method between the supplies (63.4, 63.5) of products and the grouping (10.1, 10.2) are introduced a supply control, a supply buffer storage and a controlled delivery. The means (64.2, 64.3, 64.4 etc.) for performing these three method stages are constituted by conveyors with cams or drivers, which are interconnected with a drag connection and which are moved by two substantially independently controlled drives on a continuous guide. The drivers are controlled following an acceptance point at which they have accepted a product from the supply unit (63.4, 63.5) and faulty products are recorded. They then pass into a buffer storage space and leave the latter through a controlled delivery point, where they deliver the product into the grouping.

10 Claims, 5 Drawing Sheets

FIG. 3A

| | A | B | C | D | E | F | G | H | I | K | L | M | N | O | P | Q | R |
|---|---|---|---|---|---|---|---|---|---|---|---|---|---|---|---|---|---|
| 1 | + | + | + | + | + | + | + | + | + | + | + | + | + | + | + | + | + |
| 2 | + | + | + | + | + | + | − | − | + | + | + | + | + | + | + | + | + |
| 3 | + | − | − | − | − | − | + | + | − | − | − | − | + | + | + | + | + |
| 4 | + | + | + | − | − | − | − | − | − | − | + | + | + | − | − | − | − |
| 5 | − | − | − | − | − | + | − | − | − | − | − | − | + | + | + | − | − |
| 6 | − | − | − | − | + | + | + | + | + | + | + | + | + | + | + | + | + |

FIG. 3B

| | .1 | .2 | .3 | .4 | .5 | .6 | .7 | .8 | .9 | .10 | .11 | .12 | .13 | .14 | .15 | .16 | .17 | .18 |
|---|---|---|---|---|---|---|---|---|---|---|---|---|---|---|---|---|---|---|
| 11.1 | + | + | + | + | + | + | + | + | + | + | − | + | + | + | + | + | + | + |
| 11.2 | + | + | + | + | + | + | + | + | + | + | + | + | + | + | + | + | + | + |
| | A | B | C | D | E | F | I | K | L | M | N | O | P | Q | R | | | |
| 11.3 | + | + | + | − | − | − | + | + | + | − | − | + | + | + | + | + | + | + |
| | A | G | H | I | K | L | N | O | P | | | Q | R | | | | | |
| 11.4 | + | + | + | − | − | + | + | + | + | + | + | + | + | + | + | + | + | + |
| | A | B | C | D | E | L | M | N | | | | | | | | | | |
| 11.5 | + | + | + | + | + | + | + | + | + | + | + | + | + | + | + | + | + | − |
| | F | N | O | P | | | | | | | | | | | | | | |
| 11.6 | + | + | + | + | + | + | + | + | + | + | − | + | + | + | + | + | + | + |
| | E | F | G | H | I | K | L | M | N | O | | P | Q | R | | | | |

FIG. 3C

| 1 | .1 | .2 | .3 | .4 | .5 | .6 | .7 | .8 | .9 | .10 | .11 | .12 | .13 | .14 | .15 | .16 | .17 | .18 | .19 | .20 | .21 |
|---|---|---|---|---|---|---|---|---|---|---|---|---|---|---|---|---|---|---|---|---|---|
| | A | B | C | D | E | F | G | H | I | K | X | L | M | N | O | Y | P | Y | Y | Q | R |
| 13.2 | + | + | + | + | + | + | − | − | + | + | − | + | + | + | + | − | + | − | − | + | + |
| 13.3 | + | − | − | − | − | − | + | + | ⊕ | ⊕ | − | ⊕ | − | + | + | − | + | ⊕ | ⊕ | + | + |
| 13.4 | + | + | + | ⊕ | ⊕ | − | − | − | − | − | − | + | + | + | − | − | − | − | − | − | − |
| 13.5 | − | − | − | − | − | + | − | − | − | − | − | − | − | + | + | − | + | − | − | − | − |
| 13.6 | − | − | − | − | + | + | + | + | + | + | − | + | + | + | + | ⊕ | + | − | − | + | + |

METHOD AND APPARATUS FOR PRODUCING GROUPS FROM DIFFERENT PRINTED PRODUCTS

FIELD OF THE INVENTION

The invention is in the field of the processing of printed products and relates to a method and an apparatus which serve to continuously form groups from different flat articles, particularly printed products, which are supplied in different, timed flows, e.g. scale flows.

BACKGROUND OF THE INVENTION

For the further processing stages of printed products as from the printing press or intermediate products produced therefrom, it is necessary to in each case form into a group a specific number of different products of this type. Typical examples are the compilation or collection of different printed products for producing books or booklets or the insertion of different inserts or supplements in folded newspapers. Apparatuses, which e.g. combine into a flow of printed product groups a number of printed products entering in scale formation form are known. They conventionally comprise a plurality of feed or supply units, e.g. winding stations or feeders and a grouping unit, e.g. an insertion drum. Such apparatuses are e.g. described in U.S. Pat. Nos. 4,471,953 and 5,052,667.

Such apparatuses are e.g. monitored, in that each group is checked for the correct thickness. Groups which do not satisfy this inspection are then identified and usually extracted. As the extracted groups are caused by different errors in the supply or grouping, they have different forms or compilations and can consequently only be automatically divided up into the individual products and returned to the production line with considerable apparatus expenditure. Therefore these faulty groups are usually either completed by hand or sorted out for the return of the individual product, or are not returned to the production line. These faulty groups always constitute a material and/or personnel-intensive point in the production sequence.

The described disadvantage of the prior art methods and apparatuses for forming groups from different printed products and for checking the said grouping becomes a significant problem when it is a question of modifying the formation of the groups to be formed with high frequency, e.g. for each individual group and coordinating this change with further processing stages.

This is necessary if, in newspapers which are to be addressed, the individual groups of supplements, i.e., corresponding to the individual addresses, have to be inserted, a grouping process known as personalized insertion. An apparatus for forming individual groups of printed products is described in U.S. Pat. No. 3,966,186 (Helm). Using existing methods and apparatuses faulty groups resulting from errors in the supply of the individual products can only be recognized after grouping and eliminated only just prior to addressing, when the grouping unit is already dealing with the formation of subsequent groups. Thus, not only do faulty groups have to be further processed in a complicated and costly manner as described hereinbefore, but also the eliminated groups are missing from the addressing sequence and must be re-formed at a later time. However, if packing directly follows addressing and the addressing sequence is matched to a packing sequence, the grouping errors are propagated via the missing addresses to the packing stage and the aim is to avoid such a propagation of errors.

SUMMARY OF THE INVENTION

An object of the invention is to so improve the method and apparatus for the continuous grouping of different flat articles, particularly for forming printed product groups of individual composition, that no faulty groups occur. As a function of the particular use, errors in the supplies of the individual printed products will cause the formation of groups to be interrupted so that no improper group is formed, leading to gaps in the flow of formed printed product groups. This is also true of groups with a simple, always identical formation, e.g. consisting of a single printed product, which can easily be eliminated from the production line before the next processing stage and can be returned to said production line. It is in this way possible to produce a group flow with a predetermined group sequence, which can have gaps and the locations of said gaps are identified.

BRIEF DESCRIPTION OF THE DRAWINGS

This object is achieved by the method and the apparatus according to the invention which are described in greater detail hereinafter relative to the drawings, wherein:

FIGS. 3A, 3B and 3C are tables of predetermined and generated data for the example of FIG. 2;

DESCRIPTION OF THE PREFERRED EMBODIMENTS

From different printed products occurring in continuous or timed form, the inventive method produces a continuous flow of printed product groups, which can comprise a different number of the individually supplied products, as a function of a predetermined sequence. The increased production reliability of the inventive method compared with the prior art is based on the fact that errors in the supply of the individual printed products are detected at an early stage and that as a reaction to the detection of such an error the formation of the corresponding group is displaced by one cycle.

The inventive method essentially comprises three method stages, namely a supply control or check of the individual supplies, a supply buffer storage of the individual supplies and a controlled delivery of the individual products into a timed grouping. The supply control detects errors or gaps in the supplies of products. With the controlled delivery, which is subject to the same timed cycle as the grouping, the supplied products are delivered in accordance with the predetermined formation of the individual groups and corresponding to the detected errors in the grouping. The supply buffer storage permits a continuous supply, despite a non-continuous delivery.

The supply control must be such that before the first product of a group enters the grouping, it is known whether the other products intended for this group are or are not present in the correct form. If all the corresponding products are present, the group is correctly formed, i.e. the corresponding products are delivered in the corresponding cycles, but if one or more of the products necessary for the group are not present, the group is not formed in the predetermined cycle, i.e. no products are delivered in the corresponding cycles. The group is formed in the next cycle, when the necessary products are present. In order to make continuous supply possible in spite of non-continuous delivery into the grouping section, the products are buffered upstream of delivery. The degree of filling of a buffer storage area determines the speed of the supply thereto.

Figure 1A:
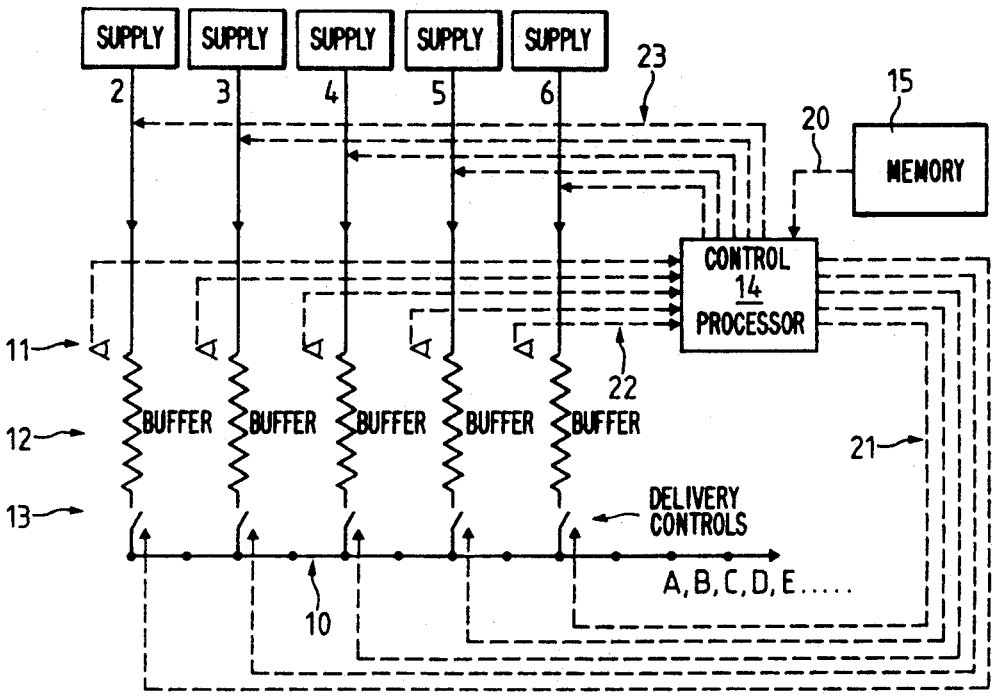
FIGS. 1*a* and 1*b* are schematic diagrams illustrating the method of the invention.
Figure 1B:
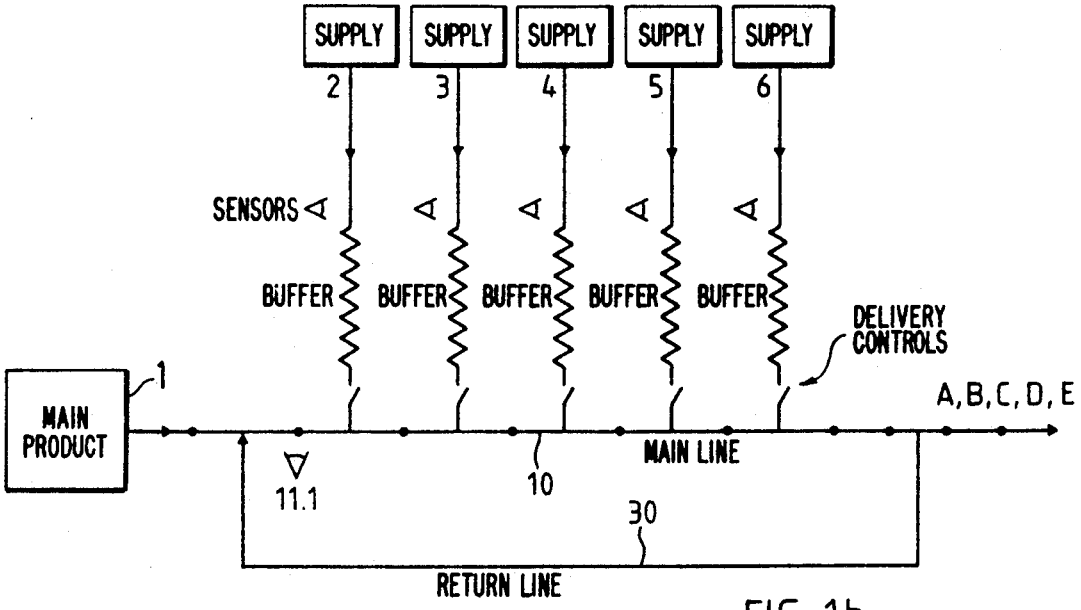

FIGS. 1*a* and 1*b* show as basic diagrams two variants of the inventive method.

FIG. 1*a* shows a method with five equal status supplies with which, on a grouping section or line 10, groups A, B, C, D, etc. consisting of a group-specific selection of individual products 2, 3, 4, 5 and /or 6 are formed. Before issuing into the grouping section, the five product flows pass through the aforementioned method stages, namely supply control 11 (diagrammatically shown as an eye), supply buffer storage 12 (diagrammatically shown as a zig-zag line) and control delivery 13 (diagrammatically shown as a switch), the supply control being located at the entrance to the buffer storage area and the controlled delivery at the exit therefrom. A data processing means 14 has access to a memory 15 as indicated by arrow 20, in which the compositions of the groups A, B, C, D, E, etc. to be formed are stored. The supply control 11 of each supplied product flow also supplies data to the data processing means 14 (arrow 22), with which errors in the supplies are indicated and localized. The data processing means processes control data (arrow 21) for the controlled delivery 13, which are calculated on the one hand by means of the group data 15 and on the other by means of the errors in the supplies.

The minimum necessary degree of filling of the buffer storage areas 12 is a function of the frequency with which a specific product is required in the groups and the frequency of the supply errors. If these two frequencies for the different supplies are roughly the same, the supplies issuing into the grouping section for downstream use require a larger buffer storage content, because the buffer storages must contain more products for groups already in the grouping process. The data processing means 14 determines the degree of filling of the individual buffer storages from the data available to it and supplies control data (arrow 23) with which the supply speeds of the corresponding products are controlled.

In order to make it possible to prevent the formation of a faulty group, prior to the entry of the first product of a group in the grouping section 10, it must be known whether all the products necessary for this specific group are present, i.e. these products must already have passed the corresponding supply control and be located in the buffer storage area. If they are completely present the group is formed, but if they are not completely present the group is not formed and is instead displayed by one cycle. An error in one of the supplies consequently leads to a gap in the group flow A, B, C, etc. following the displaced group.

FIG. 1*b* shows a method with a master supply of a main product 1, which only has a supply control 11.1, but not a supply buffer storage and no controlled delivery. The remaining supplies 2 to 6 correspond to those of FIG. 1*a*. This method presupposes that the main product 1 is to be contained in each group to be formed. If an error is detected in the supply 1, the other products in the corresponding cycles are not delivered, i.e. a gap is formed in the group flow. If an error is detected in one of the supplies 2 to 6, then for the corresponding group no products 2 to 6 are delivered, but instead a product 1 is delivered, which does not pass through a controlled delivery, so that in place of a group an individual product 1 occurs in the group flow. This can be easily returned via a corresponding return means 30 to the supply 1, so that also at such a point a gap occurs in the group flow. Such a method is advantageous for the individual insertion of supplements in newspapers or magazines, the newspaper or magazine constituting the main product.

Figure 2:
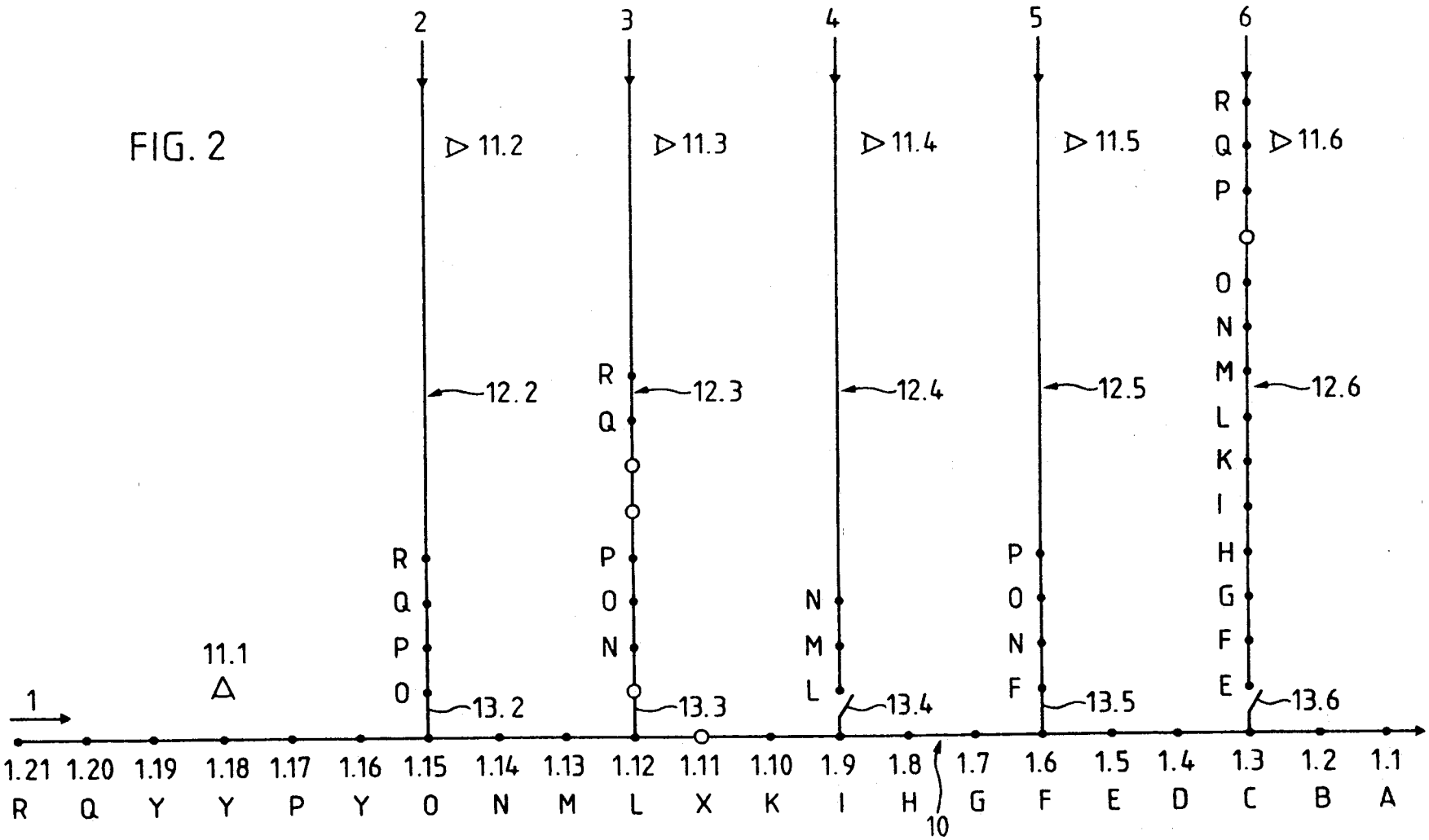
FIG. 2 is a diagram illustrating the method of the invention by referring to a specific example.

By means of a specific example, FIGS. 2 and 3A through 3C illustrate the method according to FIG. 1*b* in detail. FIG. 2 shows the apparatus aspect and FIGS. 3A–3C the data aspect of the method.

FIG. 2 again shows the supplies 1 to 6 to a grouping section 10 which can comprise of an insertion drum, in which in each main product 1 is inserted a group-specific number of individual products 2 to 6. Supplies and grouping sections are diagrammatically shown as lines with dots for the individual products. A missing product is indicated by a circle. The individual main products (also gaps in the main product flow 1) are continuously numbered (1.1, 1.2, 1.3, 1.4, 1.5, etc.). The supplies of the products 2 to 6 have, as described, in each case a supply control 11.2-6, a supply buffer storage 12.2-6 and a control delivery 13.2-6. The main product supply 1 only has a supply control 11.1. The individual products are moved with supply means through the buffer storage area, e.g. with clips or clamps, which in each case grip a product upstream of the supply control. The main product can be supplied without supply means as a scale flow. The grouping section can be an insertion drum.

The arrangement shown in FIG. 2 is now to be used for producing a flow of groups A, B, C, D, etc., whose group-specific composition is given in the top table of FIG. 3A. A + in the line of a particular product means that it is to be present in the group of the corresponding column and a − means that the product is to be missing in the corresponding group. This table makes it clear that each group must contain the main product 1 and a varying number of further products. However, the table can be extended to any random length.

The second table in FIG. 3B contains the data supplied by the supply controls 11.1-6. A + in the line of a product means that the supply means, in accordance with the running number of the column, carries a corresponding product, whereas a − means that the corresponding means is empty, i.e. a supply error is present. For the main product (line 1) it is not necessarily an empty supply means, but could possibly be a gap in a scale flow. The continuous or running numbering of the supply means or points in the scale flow of the main product is a representation aid. It is randomly chosen as if when point 1.1 passed through the grouping section for forming the group A, all the supply means 2-6.1 had been in delivery position. However, any other consecutive numbering would also be justified.

It can be gathered from the second table in FIG. 3B that the main product at point 1.11 is missing. Therefore the group flow has at point 1.11 a gap X (no main product and no product 2-6). It can also be gathered from the second table that the supply of the product 2 is fault-free, that product 3 is missing on the supply means 3.4, 3.5, 3.6, 3.10, 3.11 and that also the supplies of products 4, 5 and 6 have errors.

By means of the data in FIG. 3A it is possible to now associate each product in FIG. 3B with a group. The corresponding associations are given below the +/− signs. The + sign in the lines of the products 2 to 6 can be successively associated with in each case one group, which should contain such a product. Gaps in the supply flows which can be associated with groups containing no corresponding product have no effect on the association (e.g. 3.4, 3.5, 4.4 and 4.5). Gaps in the supplies between adjacent groups, both of which should contain the product, act as errors on the grouping. They must lead to the suppression of the corresponding group formation and to an error group Y, which only consists of the product 1 (e.g. 3.10, 3.11 and 6.11).

It can be seen that up to the group K, the groups can be formed without any interruption. This is followed by a gap X, then the groups up to O, followed by an empty main product Y. This is followed by the group P, two empty main products Y, the group Q, etc. This sequence can now be associated with the points of the main product flow, as indicated in FIG. 2 and as can be passed to a following processing stage.

From the data of the tables of FIGS. 3A and 3B tables and from the corresponding associations of the products to groups, the data processing means now calculates the controlled data for the controlled delivery, such as can be gathered from the third table of FIG. 3C. The delivery is either active (marked with +) and allows the passage of a supply means, or is passive (marked with −) and allows the passage of no supply means. A distinction can be made between three cases:

+ delivery is active, because there is a supply means with product and a product is needed, ∘ delivery is active, because there is an empty supply means and no product is needed (corresponding group composition or no group), − delivery is passive, because there is a product, but no product is needed (corresponding group composition or no group).

The case where an empty supply means exists and a product is needed does not occur, because in this case no group is formed.

Whereas FIGS. 3A–3C shows the data necessary and generated in one portion of the grouping process, FIG. 2 is an instantaneous photograph. Groups A and B are already formed, groups C to O are on the grouping section and groups C, F, I, L and O are just passing the delivery points of products 2 to 6, a product 5 being added to group F and a product 2 to group O. The corresponding deliveries 13.5 and 13.2 are consequently active, while 13.6 and 13.4 are passive, because the corresponding products are present, but not needed in the corresponding groups. Delivery 13.3 is active, because group L requires no product 3, but an empty supply means must pass. The control signals generated for this position of the controlled deliveries, are interconnected by a broken line in the third table of FIG. 3C.

The second table of FIG. 3B also indicates the moment represented in FIG. 2, namely with a broken line further to the right and a broken line further to the left, enclosing between them those data and associations, which are relevant to the moment represented in FIG. 2. The data and associations to the right of the right-hand line are not yet relevant, because the corresponding groups are not yet being processed, while the data to the left of the left-hand line are no longer relevant, because the corresponding products have already been added to the groups.

In order that the sequence of groups A, B, C, D, etc., gaps X and empty main products Y can be formed, the supply controls 11.1-6 must be arranged in such a way and the supply means leading to them must be so set up that before a main product or a corresponding gap is passed into the grouping section, the products or supply gaps associated with the corresponding group are present in the buffer stores 12.2-6. The associations given to the right of the right-hand broken line in the second table of FIG. 3B relate to products present in addition to the minimum necessary filling level in the buffer storage areas.

FIGS. 2 and 3A–3C relate to an example of an method variant. Similar examples can be formed for method variants with different numbers of supplies and also for method variants without a main product supply or with more than one main product supply.

Figure 4:
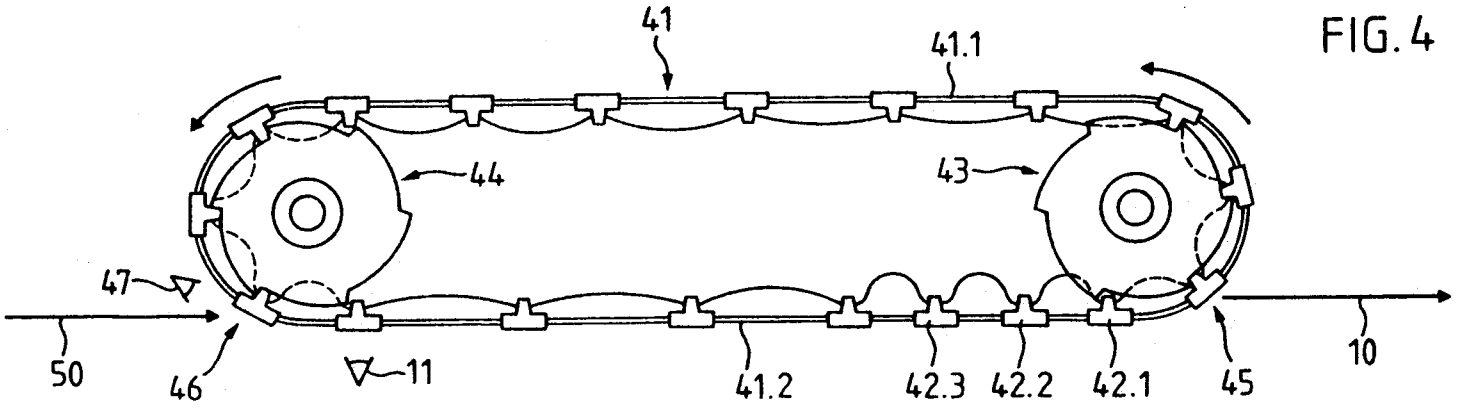
FIG. 4 is a schematic plan view of an apparatus for performing the three method stages of supply control, supply buffer storage and controlled delivery of discharge.

FIG. 4 illustrates the operating principle of an apparatus enabling the performance of the three essential method steps of supply control, supply buffer storage and controlled delivery. It is a further development of the continuously revolving piece product conveying means described in U.S. Pat. No. 4,887,809. It has a plurality of cams or drivers 42.1, 42.2, 42.3 etc. coupled together by means of a drag connection and revolving in a continuous guide 41 and which are driven at two points of the latter by in each case a separately controllable drive means 43, 44. Due to the fact that the drag connection between the drivers 42.1, 42.2, 42.3 etc. is an elastically shortenable and lengthenable spring element, the drivers can have different spacings on the guide 41 and as a result of the fact that the two drives 43, 44 are controlled substantially independently of one another, a different number of drivers or cams can at different times be positioned on the two parts 41.1 and 41.2 of the guide 41 bounded by the drives. The drive 43 functions as the drive of the controlled delivery (reference numeral 13 in the preceding drawings). It moves a driver into a delivery position 45, if it is active according to the control data FIG. 3C. In the delivery position 45 the driver is opened and the product carried by it is transferred to the grouping section 10. When the control delivery is active on the next occasion, the driver is moved against the guide part 41.1, which is only carrying empty drivers.

The drive 44 serves as a takeover or acceptance drive from any random supply means 50, e.g. a feeder. In the acceptance position 46 the driver grips a product from the supply. Shortly prior to the acceptance position is located the supply control 11, which establishes whether the passing driver does or does not carry a product. The acceptance means can also be provided with an acceptance control 47, which controls whether a driver in the acceptance position accepts or does not accept a product. If this is the case, the drive 44 is activated and the next driver is moved into the acceptance position and if not the acceptance drive remains passive until the driver has accepted a product. With such an arrangement supply errors (gaps in the supply flow) can largely be eliminated at the acceptance position, so that only errors which have escaped the acceptance control and those which occur between the acceptance point 46 and the supply control 11 need to be recorded for the control of the grouping.

When the driver has accepted a product, it is conveyed from the acceptance point 46 to the guide part 41.2, which serves as a buffer storage area. The speed of the delivery drive 43 is primarily determined by the cycle of the grouping. As to whether it is active or passive is determined by the control data generated for it (example: FIG. 3*c*, third table). The control of the acceptance drive 44 is coupled to the control of the supply means 50, so that both operate with the same clock cycle. With respect to the supply capacity (speed or operation/stoppage) the acceptance drive 44 and supply means 50 are controlled according to the filling level of the particular buffer storage area. The acceptance drive 44 can be operated in active or passive manner in accordance with the data supplied by the acceptance control 47.

For the determination of the control data for the drives 43, 44 and the supply means a central data processing is used, as has already been described in conjunction with FIG. 1*a*. The control of the acceptance drive 44 in accordance with the data of the acceptance control 47 can be taken over by the data processing. The data processing unit and the corresponding data lines are not shown in FIG. 4.

Sensors are used for the supply control 11 and acceptance control 47. These can be optical or mechanical sensors.

It is conceivable for an apparatus according to FIG. 4 to be placed in the main product flow 1 (FIG. 1*b*) upstream of the supply control 11.1 and is then primarily used for closing gaps in said flow.

Figure 5:
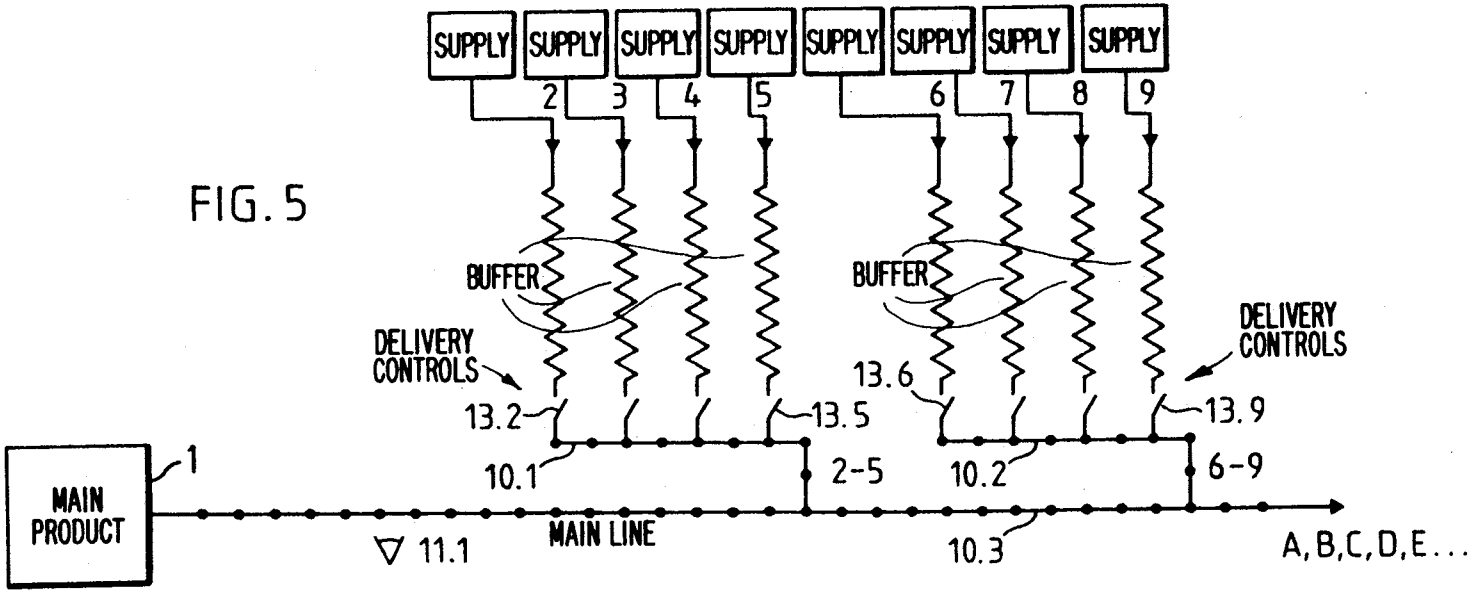
FIG. 5 is a schematic diagram of a further embodiment of the method of the invention.
Figure 6A:
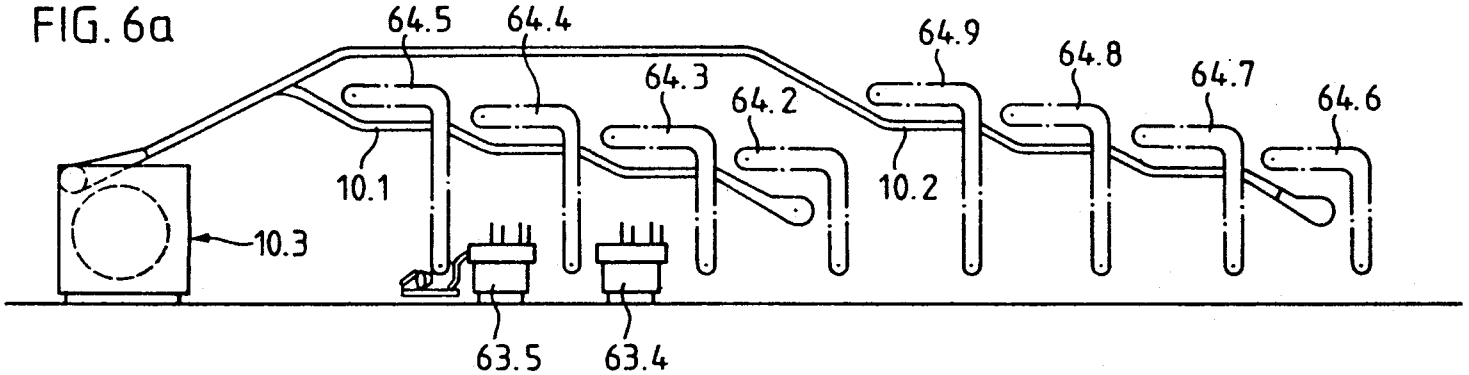
FIGS. 6*a* and 6*b* are schematic front and plan views, respectively, of apparatus for performing the method embodiment of FIG. 5.
Figure 6B:
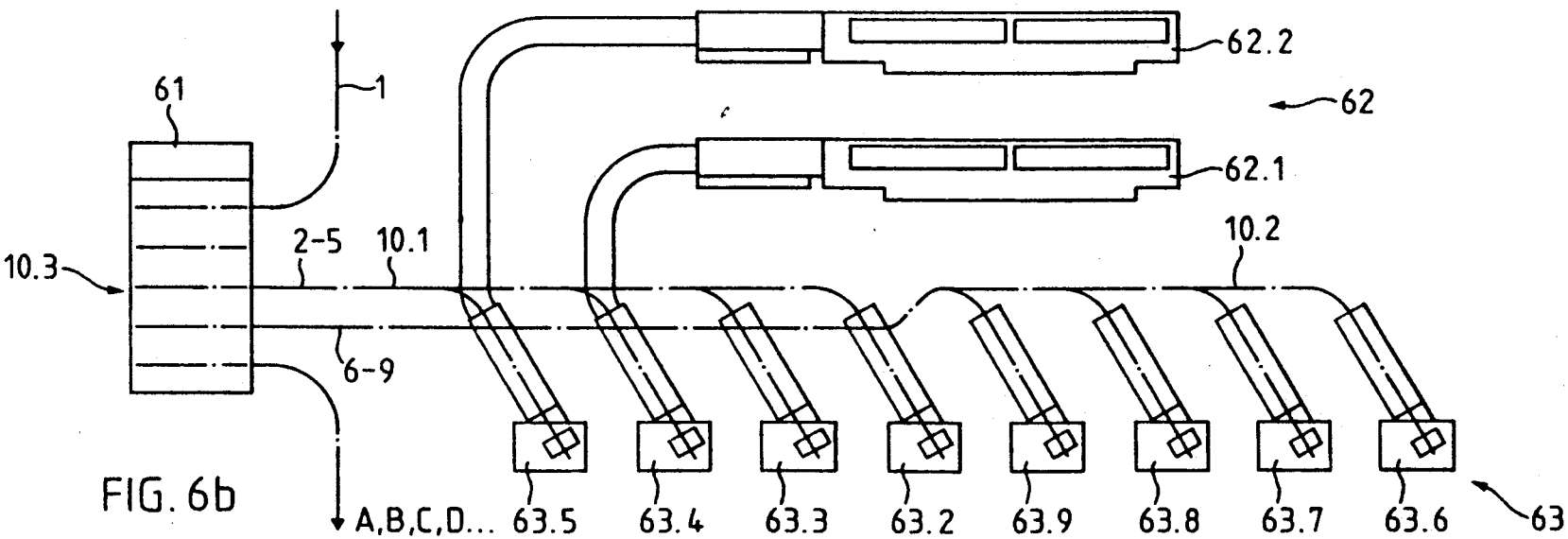

Using the same representation procedure as in FIGS. 1*a* and 1*b*, FIG. 5 shows the diagram on which is based the means for grouping the printed products of FIGS. 6*a* and 6*b*. It is once again a grouping with a main product 1, into which are grouped the products 2 to 9. The products 2 to 9 are grouped into two subgroups 2–5 and 6–9 in pregroupings 10.1 and 10.2, whose operation precisely corresponds to the method variant described in conjunction with FIG. 1*a*. The two subgroups 2–5 and 6–9 are then grouped into the main product on a main grouping section 10.3.

FIGS. 6*a* and 6*b* show an exemplified embodiment of an apparatus for performing the method in front view (FIG. 6*a*) and in plan view (FIG. 6*b*). It essentially comprises an apparatus for performing the method variant according to FIG. 5.

The function of the main grouping section 10.3 is taken over by an insertion drum 61, into which runs a main product flow 1 of e.g. folded newspapers. Product subgroups are supplied to these newspapers from the winding stations 62 (not visible in front view) and/or feeders 63 (partly visible in front view).

The product flows from the feeders 63.2 to 63.5 are guided by means of in each case one apparatus according to FIG. 4 (designated 64.2 to 64.5 in front view) to a subgrouping section 10.1, from where they are conveyed as a group flow 2-5 to the insertion drum 61. The feeders 63.4 and 63.5 can also be replaced by a supply from the winding stations 62.1 and 62.2. The product flows from the feeders 63.6 to 63.9, in the same way as the product flows from the other feeders, pass via apparatuses according to FIG. 4 (64.6 to 64.9) to a subgrouping section 10.2 and from there as a group flow 6-9 into the insertion drum 61. The subgrouping sections 10.1 and 10.2 e.g. comprise rotary paths with clips, arranged in such a way that they can successively accept a plurality of products and deliver same as a group. Folded newspapers A, B, C, D. etc. pass out of the insertion drum and contain a predetermined choice of the inserts or supplements 2 to 9.

The apparatus for grouping printed products described in conjunction with FIGS. 6*a* and 6*b* can be increased or decreased in size in a random manner and the number of groupable products becomes larger or smaller.

I claim:

1. A method of forming groups of flat articles such as printed products comprising the steps of substantially continuously supplying along each of a plurality of supply paths to a grouping region a plurality of articles to be grouped, the articles in any path being different from the articles in other paths, individually controlling delivery of articles from selected ones of the supply paths to the grouping region to form groups of selected article composition, assembling in the grouping region articles delivered from the paths into a plurality of groups with a plurality of groups being assembled in the grouping region concurrently, monitoring each supply path to detect errors in the supply of articles along the path, between monitoring and delivery of articles, buffering the flow of articles along the path in a controlled manner in a buffer storage area so that between monitoring and delivery the path includes at least as many articles as are required for the formation of groups being assembled at any monent.

2. A method according to claim 1 and including controlling the filling level of the buffer storage areas so that, at the beginning of assembly of a group, all of the products necessary for the formation of a group have passed through the step of delivery control, and wherein, when an error in the supply path is detected, assembly of a group requiring the article not supplied is delayed by one supply cycle.

3. A method according to claim 2 and including providing a central data processor and a data bank operatively associated with the data processor, storing in the data bank information defining the desired composition of each group of articles to be formed and information about the supplies of articles needed to form those groups, the data processor providing control signals for performing the steps of controlling delivery and supplying articles.

4. A method according to claim 3 and including, upstream of the controlled delivery, monitoring the supply of articles for gaps in the flow of articles and closing the gaps.

5. A method according to claim 4 wherein the monitoring for gaps and closing the gaps are performed by the central data processor.

6. A method according to claim 1 wherein the step of assembling includes receiving articles from selected ones of the paths to form pre-groups and the subsequently join selected ones of the pre-groups to form groups.

7. An apparatus for forming groups of flat articles comprising the combination of at least two supply unit means for supplying streams of articles along at least two paths to a grouping region to be grouped, the articles in a path being different from the articles in another path;

means for individually controlling delivery of articles from said supply paths to said grouping region;

means in said grouping region for assembling articles delivered from said paths into a plurality of groups with a plurality of groups being assembled concurrently in said grouping region, means for monitoring each supply path to detect errors in the supply of articles along said path, means in a buffer storage area between monitoring and delivery of articles for buffering the flow of articles along each said path in a controlled manner so that between monitoring and delivery said path includes at least as many articles as are required for formation of groups being assembled at any moment.

8. An apparatus according to claim 7 wherein each supply unit means includes a continuous guide, a plurality of article carriers movable along said guide, pulling means interconnecting said carriers, said pulling means having slack therein, independently controlled acceptance and delivery drives for moving said carriers along said guide to said grouping region, said means for monitoring including sensor means adjacent and downstream of said acceptance drive for determining whether each of said carriers does or does not carry an article.

9. An apparatus according to claim 8 wherein said monitoring means further includes sensor means adjacent said acceptance drive for determining whether a carrier has or has not received an article.

10. An apparatus according to claim 9 and including a central data processor connected to receive data from said sensors and connected to control said drives.

* * * * *